US005088451A

United States Patent [19]

Hu et al.

[11] Patent Number: 5,088,451

[45] Date of Patent: Feb. 18, 1992

[54] SLUDGE REMOVAL SYSTEM FOR REMOVING SLUDGE FROM HEAT EXCHANGERS

[75] Inventors: Min H. Hu, Murrysville; Allen C. Smith, Jr., Bethel Park; Robert M. Wilson, Plum Boro; Robert M. Wepfer, Murrysville; Howard E. Braun, Pittsburgh, all of Pa.

[73] Assignee: Westinghouse Electric Corp., Pittsburgh, Pa.

[21] Appl. No.: 506,726

[22] Filed: Apr. 9, 1990

[51] Int. Cl.[5] ..... F22B 37/48; F28G 9/00

[52] U.S. Cl. ..... 122/388; 122/382; 122/383; 165/95

[58] Field of Search ..... 122/379, 382, 383, 384, 122/385, 388; 165/95

[56] References Cited

U.S. PATENT DOCUMENTS 1,616,372 2/1927 Janson .
2,018,803 10/1935 Ostertag .
3,916,844 11/1975 Cassell .
4,079,701 3/1978 Hickman et al. .
4,303,043 12/1981 Redding .
4,407,236 10/1983 Schukei et al. .
4,452,183 6/1984 Yazidjian .
4,632,068 12/1986 Appleman et al. .
4,704,994 11/1987 Hu et al. .
4,883,036 11/1989 Sterk ..... 122/383

*Primary Examiner*—Edward G. Favors
*Attorney, Agent, or Firm*—Walter S. Stevens

[57] ABSTRACT

A system for removing sludge from a sludge-bearing fluid flowing in a vertically oriented nuclear steam generator so that the sludge is not present therein in sufficient quantities to corrode components (e.g., heat transfer tubes) located in the steam generator. The system comprises a tube sheet having a plurality of apertures therethrough for receiving the ends of the heat transfer tubes so that the tubes are supported by the tube sheet. The tube sheet has a top surface thereon and also a recess formed in the top surface for separating and for collecting the sludge from the sludge-bearing fluid. The recess has a substantially frusto-conical wall generally converging at the bottom end of the recess for providing a settling basin for the sludge after the sludge is separated from the sludge-bearing fluid. A pipe extends from adjacent the bottom end of the recess to the exterior of the heat exchanger for transporting the sludge from the recess to the exterior of the heat exchanger. A valve, which is connected to the pipe, is capable of opening to remove the sludge via blowdown through the pipe and into a holding tank for suitable disposal.

20 Claims, 5 Drawing Sheets

FIG. 3
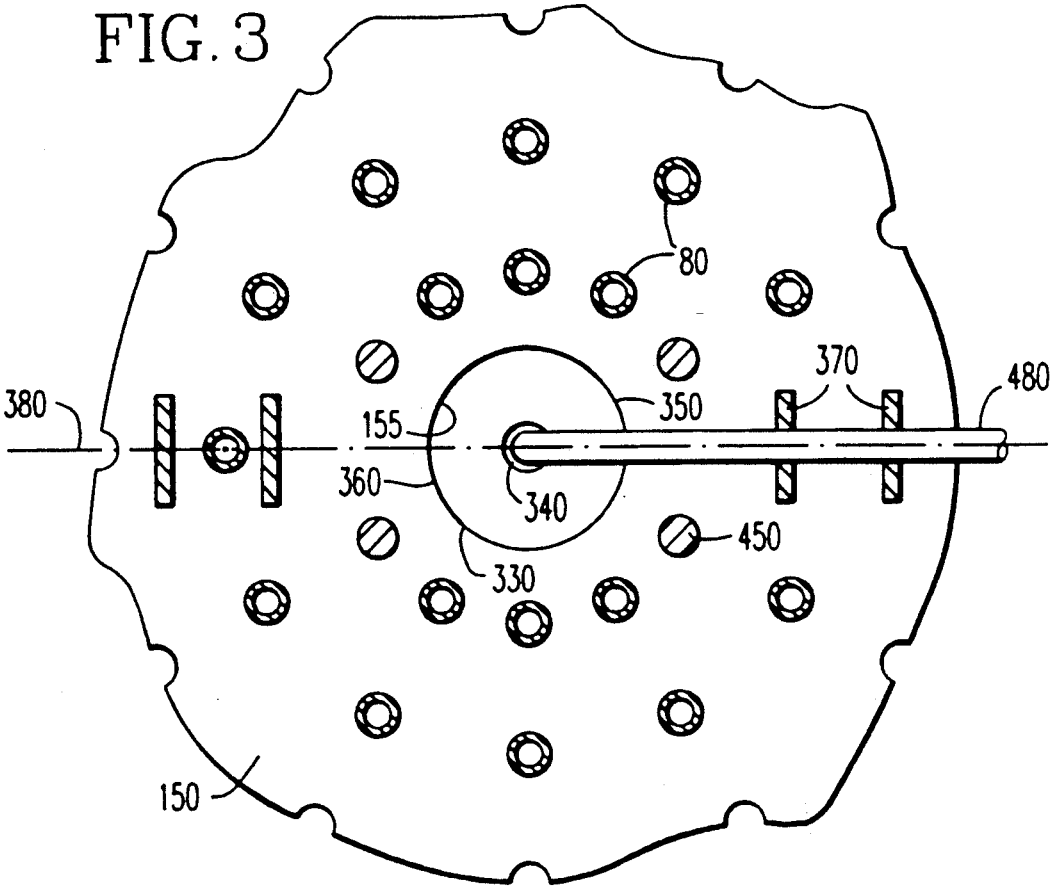
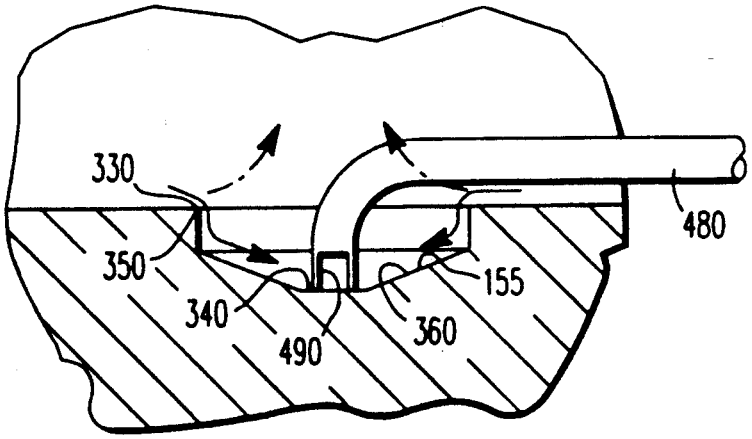
FIG. 4

SLUDGE REMOVAL SYSTEM FOR REMOVING SLUDGE FROM HEAT EXCHANGERS

BACKGROUND

This invention generally relates to heat exchangers and more particularly relates to a system for removing sludge from sludge-bearing fluid flowing in a nuclear steam generator so that the sludge is not present therein in sufficient quantities to corrosively attack components located in the steam generator.

Before discussing the problem of corrosion in nuclear steam generators, it is advisable to first consider the structure and operation of a typical nuclear steam generator. In this regard, a typical nuclear steam generator comprises a vertically oriented shell and a plurality of inverted U-shaped tubes disposed in the shell so as to form a tube bundle. A tube sheet supports the vertical portions of the inverted U-shaped tubes at their lower ends. One lower end communicates with a primary fluid inlet chamber located beneath the tube sheet and the lower end communicates with a primary fluid outlet chamber also located beneath the tube sheet. The steam generator further comprises a cylindrical wrapper sheet disposed between the tube bundle and the shell to form an annular downcomer chamber, the wrapper sheet terminating a predetermined distance above the tube sheet. Moreover, the tube sheet may have a shallow cavity in an untubed central region thereof.

During operation of the steam generator, radioactive primary fluid (e.g., water), having been heated by circulation through a radioactive nuclear reactor core, enters the primary fluid inlet chamber and flows through the tube bundle and out through the primary fluid outlet chamber. At the same time, non-radioactive secondary fluid or feedwater flows down the annular downcomer chamber and impinges the tube sheet, the feedwater from the downcomer flowing radially inwardly along the tube sheet and upwardly among the tubes inside the wrapper. The feedwater then circulates around the tubes above the tube sheet in heat transfer relationship with the outside surfaces of the tubes, so that a portion of the feedwater is converted to steam. The steam is then circulated through a turbine connected to an electrical generator for generating electricity in a manner well known in the art.

As discussed hereinbelow, contaminants may be present in the feedwater in the form of suspended particulate material. This particulate material may settle-out of the feedwater and corrosively attack and damage the tube walls such that the radioactive primary fluid flowing in the tubes will eventually commingle with the non-radioactive secondary fluid flowing around the tubes. Commingling the radioactive primary fluid with the non-radioactive secondary fluid is undesirable because such commingling may compromise the safety of the nuclear power plant. The particulate material, which may be in the form of iron oxides and copper compounds together with trace amounts of other metals and/or metal oxides or even nonmetallic constituents, tends to settle-out of the feedwater onto the tube sheet in those areas of the tubesheet where the velocity of lateral flow across the tube sheet is insufficient to prevent settling. Settling of the particulate material onto the tube sheet can be harmful because it may create buildups of sludge deposits which may act as sites for concentrated corrosive agents. As stated hereinabove, these corrosive agents may corrosively attack and damage the tube walls and eventually lead to the undesirable commingling of the radioactive primary fluid with the non-radioactive secondary fluid.

Regions of low lateral or radial flow velocity across the tube sheet may lead to the settling-out of the particulate material to create the sludge that will accumulate on the tube sheet. In order to minimize corrosion tube damage caused by sludge buildup in such low velocity areas, it is desirable to localize this sludge buildup to the regions of the tube sheet where there are no tubes (e.g., along an untubed center lane or at the untubed central region of the tube sheet). Thus, it is desirable to control the flow of secondary fluid so that regions of low lateral or radial velocity occur in those regions of the tube sheet that have no tubes. Therefore, it is preferable to obtain the smallest low velocity area and, at the same time, locate it at the center region of the tube sheet where there are no tubes. Locating the low velocity area at the center region of the tube sheet tends to localize the area of sludge build-up to the untubed center region of the tube sheet rather than at regions of the tube sheet that have tubes.

It will be understood that the feedwater enters the tube bundle from beneath the tube wrapper, the radial inwardly flow along the tube sheet is impeded by the presence of tubes. Moreover, because there are no tubes along an untubed center lane of the tube sheet, there tends to be relatively high flow velocity therealong, thereby causing relatively low flow velocity in the regions of the tube sheet where tubes are present. To minimize center lane flow velocity and thereby increase the flow velocity in the regions of the tube sheet where tubes are present, center lane blocks are provided at spaced-apart locations along the center lane to inhibit the flow of secondary fluid or feedwater therealong. However, the center lane blocks do not eliminate the presence of other low velocity regions in the tube bundle. In this regard, when the feedwater enters the tube bundle from the bottom of the wrapper near the tube sheet, the radial inwardly flow tends to immediately turn upward because the flow resistance in the vertical direction, parallel to the tubes, is now much less than that in the lateral or radial direction. This results in low velocity lateral or radial flow into the tube bundle. Therefore, a flow distribution baffle plate has been utilized to enhance lateral or radial flow velocity by reducing vertical flow velocity. Thus, this flow distribution baffle plate is positioned a predetermined distance above the tube sheet to provide additional resistance to vertical or axial flow, thereby promoting lateral flow penetration into the bundle at the tube sheet. However, even the utilization of the flow distribution baffle plate has proved only partly successful to move the low velocity or stagnation areas toward the untubed center of the tube sheet. To solve this problem, a cylindrical flow boosting member disposed coaxially above the central region of the tube sheet has been utilized to move the low velocity or stagnation areas to the untubed center region of the tube sheet. This flow boosting member also serves to increase the lateral or radial flow velocity of the secondary fluid along the tube sheet before the radial flow enters the central region of the tubesheet.

As stated hereinabove, the particulate material will settle-out onto the low velocity or stagnation areas of the tube sheet. In this regard, the baffle plate and flow booster move the stagnation area to the center region of the tube sheet, as stated hereinabove. Thus, the particulate material and deposited sludge will tend to move to and accumulate at the center region of the tube sheet. Consequently, it would be most efficient to separate the sludge from the secondary fluid at this center region of the tube sheet so that the sludge can be efficiently removed from the secondary fluid to prevent corrosion of the tubes during operation of the steam generator. Therefore, a problem in the art has been to efficiently separate the sludge from the secondary fluid at the center region of the tube sheet. Another problem in the art has been to efficiently remove the sludge from the steam generator once the sludge is separated from the secondary fluid.

A device for control of the flow of secondary fluid around the outside surfaces of heat exchanger tubes and management of the deposition of sludge on the tube sheet of such a heat exchanger is disclosed by U.S. Pat. No. 4,704,994 entitled "Flow Boosting And Sludge Managing System For Steam Generator Tube Sheet" issued Nov. 10, 1987 in the name of Min-Hsiung Hu et al. and assigned to the Westinghouse Electric Corporation. This patent discloses a baffle plate provided to reduce vertical flow velocity, thereby tending to increase the flow velocity radially inwardly along the tube sheet. This patent also discloses a flow booster provided to enhance the flow of feedwater radially inwardly along the tube sheet. In addition, this patent discloses a central recess formed in a central region of the upper surface of the tube sheet. Moreover, the Hu et al. patent states that a blowdown pipe may be provided just above the tube sheet along an untubed center tube lane. Although the Hu et al. patent states that a central recess and a blowdown pipe may be provided for sludge management, the Hu et al. patent does not appear to disclose blowdown means having an intake orifice disposed in the recess for driving sludge from the recess and for efficiently removing the sludge from the steam generator.

A mud drum for collecting concentrated solids from the recirculating carry-over water within a nuclear steam generator is disclosed by U.S. Pat. No. 4,303,043 entitled "Sludge Collection System For a Nuclear Steam Generator" issued Dec. 1, 1981 in the name of Arnold H. Redding and assigned to the Westinghouse Electric Corporation. The Redding device provides a settling chamber or sludge collection chamber which is interposed between the recirculating carry-over water and the incoming feedwater, to intercept the recirculating water and retain at least a portion thereof in a substantially stagnant condition to permit the highly concentrated entrained solids to be deposited within the chamber. Moreover, this patent discloses that a blowdown pipe extends from the chamber to exteriorly of the heat exchanger to permit occasional or continuous discharge of the collected solids from the chamber. Although the Redding patent discloses a settling chamber and a blowdown pipe, this patent does not appear to disclose a settling chamber located on the tube sheet for collecting sludge settling on the tube sheet.

Therefore, although the patents recited herein-above disclose devices for controlling sludge buildup in a nuclear steam generator, these patents do not appear to disclose separating means located on the tube sheet for separating the sludge from sludge-bearing fluid flowing in the steam generator, blowdown means having an intake orifice disposed in the sludge separating means for removing the sludge separated from the sludge-bearing fluid, in combination with flow means disposed adjacent the separating means for directing the flow of the sludge-bearing fluid toward the separating means.

Consequently, what is needed is a system for removing sludge from sludge-bearing fluid flowing in a nuclear steam generator so that the sludge is not present therein in sufficient quantities to corrosively attack components located in the steam generator.

SUMMARY

Disclosed herein is a system for removing sludge from sludge-bearing fluid flowing in a nuclear steam generator so that the sludge is not present therein in sufficient quantities to corrosively attack components located in the steam generator. Generally speaking, this system comprises separating means disposed in the heat exchanger for separating the sludge from the sludge-bearing fluid, blowdown means having an intake orifice disposed in the separating means for removing the sludge separated from the sludge-bearing fluid, in combination with flow means disposed adjacent the separating means for directing the flow of the sludge-bearing fluid toward the separating means.

More specifically, the system of the present invention comprises a plate member or tube sheet (i.e., the separating means) disposed in a steam generator, the tube sheet having a plurality of apertures therethrough for receiving the ends of a plurality of heat transfer tubes so that the tubes are supported by the tube sheet. The tube sheet has a top surface thereon and also a recess formed in the top surface for substantially separating and for collecting the sludge separated from the sludge-bearing fluid. The recess has a generally circular open top end and a closed bottom end. The recess may have an annular 90 degree (i.e., sharp-edged) shoulder depending from the open top end of the recess. The recess, which also may have a frusto-conical wall, defines a settling basin for the sludge after the sludge is substantially separated from the sludge-bearing fluid. The frusto-conical wall of the recess assists in allowing the separated sludge to slide downwardly therealong and preferentially accumulate at the bottom end of the recess for efficient removal.

Surrounding the tube bundle is a wrapper sheet defining an annular downcomer region between the steam generator shell and the wrapper sheet. Disposed inwardly of the wrapper sheet and interposed between a lowermost support plate and the tube sheet is flow means, such as a baffle plate, for directing the flow of the sludge-bearing secondary fluid laterally or radially inwardly beneath the baffle plate. The baffle plate has a cutout for passage of the substantially sludge-free fluid therethrough after the sludge has been substantially separated from the sludge-bearing fluid by gravitational settlement in the quiescent region of the fluid which is separated from the circulating body of fluid by the sharp-edged shoulder belonging to the recess.

Moreover, blowdown means, such as a conduit or pipe, extends from near the bottom end of the recess to the exterior of the heat exchanger for transporting the sludge from the recess to the exterior of the heat exchanger. The pipe has an intake orifice at one end thereof for passage of the sludge therethrough, the intake orifice being disposed adjacent to the bottom end of the recess so that the intake orifice is in close proximity to the sludge that will settle into the recess. The pipe is in turn connected to a valve, which belongs to the blowdown means referred to hereinabove, for allowing the sludge to blowdown through the pipe during operation of the steam generator. The valve is operable to allow the sludge to blowdown through the pipe and into a sludge holding tank located exteriorly to the steam generator shell. A pump may also be connected to the pipe for removing the collected sludge from the recess when the steam generator is shutdown.

During operation, feedwater flowing downwardly through the downcomer region exits the lower end of the downcomer region and impinges the tube sheet. The feedwater that impinges the tube sheet moves laterally or radially inwardly therealong. However, as the feedwater impinges the tube sheet it tends to be deflected therefrom and move vertically upwardly through the tube bundle at the tube sheet, the vertical flow velocity through the tube bundle tending to be greater than the radial flow velocity along the tube sheet. However, the baffle plate disposed above the tube sheet reduces this vertical flow velocity and tends to increase the flow velocity radially inwardly along the tube sheet. In addition, a flow booster is interposed between the baffle plate and the tube sheet to enhance the flow of feedwater radially inwardly along the tube sheet. Thus, in the region of the flow booster, the bulk of the radial feedwater flow is forced to pass beneath the flow booster and close to the tube sheet to escape upwardly through the center of the flow booster, through a center cutout formed through the baffle plate, and through flow passages formed through the support plates. The flow booster reduces the low velocity areas in the tube bundle at the tube sheet and serves to localize the low velocity or stagnation areas to the untubed central region of the tube sheet where the flow booster and recess are located.

Thus, as the sludge-bearing fluid flows radially inwardly along the tube sheet from the lower end of the downcomer region, it will migrate toward the recess. The sludge will then fall under force of gravity into the recess and settle therein, thereby producing a secondary fluid that is substantially sludge-free. This substantially sludge-free fluid will flow upwardly into the flow booster. Simultaneously, the frusto-conical wall of the recess assists in allowing the separated sludge to slide downwardly therealong and preferentially accumulate in a confined space at the bottom end of the recess. Accumulation of the sludge in the confined space at the bottom end of the recess allows for efficient removal of the sludge from the recess by the intake orifice belonging to the blowdown pipe, which intake orifice is disposed adjacent to the bottom end of the recess. The valve, which is connected to the pipe, will allow the sludge to blowdown through the pipe and into a holding tank for suitable disposal when the valve is open.

Therefore, an object of the present invention is to provide a system for removing sludge from a sludge-bearing fluid flowing in a vertically oriented steam generator.

A feature of the invention is the provision of a tube sheet having a recess formed in the top surface thereof for separating and for collecting the sludge from the sludge-bearing fluid flowing in the steam generator.

Another feature of the invention is the provision of a conduit in communication with the recess and a valve connected to the conduit for continuously removing the collected sludge from the recess during operation of the steam generator.

Yet another feature of the invention is the provision of a pump connected to the conduit for removing the collected sludge from the recess when the steam generator is shutdown.

In addition, an advantage of the invention is that sludge collected in the recess may be suitably efficiently removed from the steam generator either continuously during operation or when the steam generator is shutdown.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings, wherein:

FIG. 3 is a view of the invention along section line III—III of FIG. 2;

FIG. 4 is another view in partial vertical elevation of the invention disposed in the steam generator;

DESCRIPTION OF THE PREFERRED EMBODIMENTS

Contaminants in the form of suspended particulate material may be present in the feedwater of a nuclear steam generator. This particulate material may settle-out of the feedwater at the tube sheet region and form sludge that may corrosively attack and damage the steam generator tube walls at the tube sheet region such that the radioactive primary fluid flowing in the tubes will eventually commingle with the non-radioactive secondary fluid flowing around the tubes. Such commingling of the primary and secondary fluids may ultimately compromise the safety of the nuclear power plant. Therefore, it is desirable to separate the sludge from the secondary fluid and to remove a substantial quantity of the sludge from the steam generator once the sludge is separated from the secondary fluid so that relatively large quantities of the sludge will not be present to corrosively attack the tubes. Disclosed herein is a system for removing sludge from sludge-bearing fluid flowing in a nuclear steam generator so that the sludge will not be present therein in sufficient quantities to corrosively attack components (e.g., heat transfer tubes) located in the steam generator.

Figure 1:
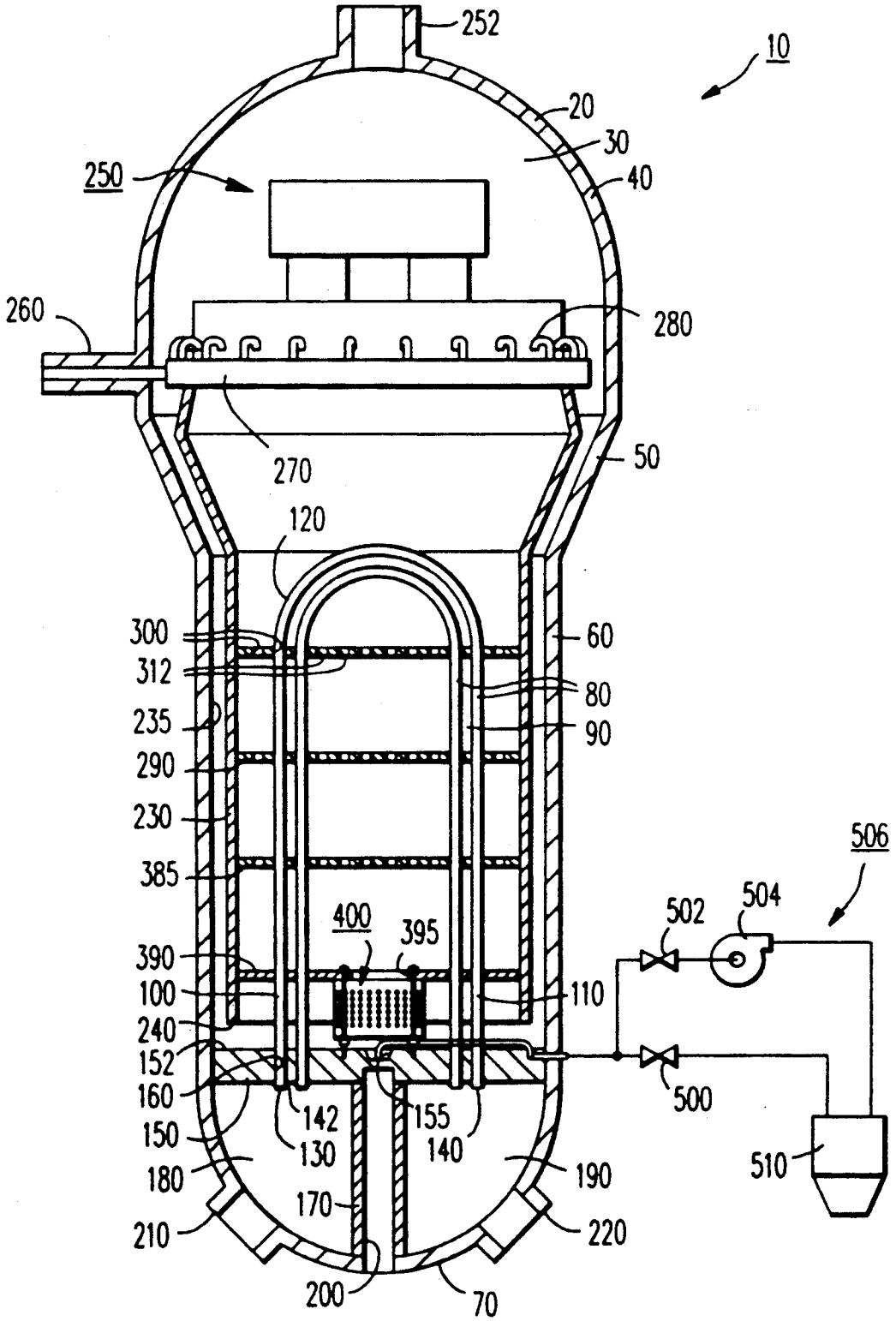
FIG. 1 is a partial cross-sectional view in elevation of a typical steam generator generally illustrating the invention disposed therein.

Referring to FIG. 1, there is illustrated, with parts removed for clarity, a type of heat exchanger or steam generator, generally referred to as 10, for producing steam. Steam generator 10 comprises a vertically-oriented generally cylindrical shell 20 defining a generally cylindrically-shaped cavity 30 therein. Shell 20 has a generally dome-shaped upper shell portion 40, a generally frusto-conical transition portion 50 integrally attached to upper shell portion 40, a generally cylindrical hull portion 60 integrally attached to transition portion 50, and a generally dome-shaped lower shell portion 70 integrally attached to hull portion 60. Disposed in cavity 30 are a plurality of vertically-oriented inverted U-shaped steam generator tubes 80 for conducting radioactive primary fluid (e.g., water) therethrough, the plurality of tubes 80 defining a tube bundle 90. Each U-shaped tube 80 has a substantially straight first tube leg portion 100 and a substantially straight second tube leg portion 110 interconnected by a U-bend tube portion 120 integrally formed therewith. First tube leg portion 100 and second tube leg portion 120 have an open first tube end 130 and an open second tube end 140, respectively, for passage of the primary fluid therethrough. Disposed in cavity 30 near lower shell portion 70 is separating means, such as a horizontal generally circular plate member or tube sheet 150, having a plurality of apertures 160 therethrough for receiving first tube ends 130 and second tube ends 140 so that tubes 80 are supported by tube sheet 150 at tube ends 130 and 140. Tube ends 130 and 140 are attached to tube sheet 150, such as by weld beads 142. The tube sheet 150 may be stainless steel for resisting corrosive attack by accumulated particulate contaminates (i.e., sludge). As described more fully hereinbelow, tube sheet 150 is not only capable of supporting tube ends 130 and 140, but is also capable of separating the particulate contaminates from the secondary fluid so that tubes 80 will not experience corrosive attack. In this regard, the separating means or more specifically, tube sheet 150, has a top surface 152 thereon and a recess 155 formed in top surface 152 for reasons disclosed more fully hereinbelow.

Still referring to FIG. 1, vertically disposed in lower shell portion 70 is a divider plate 170 for dividing lower shell portion 70 into an inlet plenum chamber 180 and an outlet plenum chamber 190. A channel 200 may vertically extend from tube sheet 150, through divider plate 170, and through lower shell portion 70 for reasons disclosed in more detail hereinbelow. Integrally attached to lower shell portion 70 is an inlet nozzle 210 and an outlet nozzle 220 in communication with inlet plenum chamber 180 and outlet plenum chamber 190, respectively. Disposed in cavity 30 above tube sheet 150 and interposed between shell 20 and tube bundle 90 is a generally cylindrical annular wrapper sheet 230 defining an annular downcomer region 235 between shell 20 and wrapper sheet 230. Wrapper sheet 230 is open at its bottom end 240 and closed at its top end except for a plurality of holes (not shown) in its top end for passage of a steam-water mixture therethrough. Mounted atop wrapper sheet 230 is a moisture separator assembly, generally referred to as 250, for separating the steam-water mixture into liquid water and dry saturated steam. Moisture separator assembly 250 also has holes (not shown) in the bottom portion thereof for receipt of the steam-water mixture from wrapper sheet 230 and also holes (now shown) in the top portion thereof for passage of the dry saturated steam therethrough. In addition, integrally attached to the top of upper shell portion 40 is a main steam line nozzle 252 for passage of the dry saturated steam flowing from moisture separator assembly 250. Moreover, integrally attached to upper shell portion 40 is a feedwater nozzle 260 for passage of secondary fluid or feedwater (e.g., water) into a generally toroidal feedring 270 which is in fluid communication with feedwater nozzle 260. Feedring 270 surrounds wrapper sheet 230 at the top end of wrapper sheet 230 and has a plurality of inverted J-shaped pipes 280 attached thereto. Pipes 280 are in communication with the interior of feedring 270 for passage of the feedwater from feedring 270, through pipes 280 and into downcomer region 235. Disposed inwardly of wrapper sheet 230 are a plurality of horizontal spaced-apart generally circular tube support plates 290 (only three of which are shown) having holes 300 therethrough for receiving each tube 80 so that each tube 80 is supported thereby. Moreover, centrally formed through each support plate 290 are a plurality of generally circular flow passages 312 for passage of the secondary fluid therethrough.

Referring now to FIGS. 1, 2, 3, and 4, recess 155 is preferably formed on top surface 152 of the separating means (i.e., tube sheet 150) at the center region of tube sheet 150 where there are no tubes 80. Recess 155 has a generally circular open top end 330 and a closed bottom end 340. Recess 155 may be generally frusto-conical in transverse cross-section and may have a 90 degree (i.e., sharp-edged) shoulder 350 depending from top end 330. Recess 155, may have a substantially frusto-conical wall 360 generally converging at the bottom end 340 of recess 155 for preferentially directing the sludge to a confined space at bottom end 340 after the sludge is separated from the sludge-bearing secondary fluid. Wall 360 extends from near shoulder 350 to the bottom end 340 of recess 155. Moreover, integrally attached to top surface 152 of tube sheet 150 may be a plurality of axially aligned center lane blocks 370 for reducing the flow velocity of the sludge-bearing secondary fluid in the lateral or radial direction along an untubed center lane 380 defined by tube sheet 150 and tubes 80. Reducing the flow of the secondary fluid in the radial direction along center lane 380 increases the secondary fluid flow parallel to tubes 80 so that heat transfer is increased between the secondary fluid and the outside surfaces of tubes 80. Center lane blocks 370 are coaxially aligned along center lane 380 and are attached to tube sheet 150. Center lane blocks 370 are capable of being positioned along center lane 380 of tube sheet 150 because by definition center lane 380 does not have any of the tubes 80 to interfere with placing center lane blocks 370 thereat. Disposed inwardly of wrapper sheet 230 and interposed between a lowermost support plate 385 and tube sheet 150 is flow means comprising a horizontal circular baffle plate 390, attached to wrapper sheet 230, for directing the flow of the sludge-bearing secondary fluid laterally or radially inwardly beneath baffle plate 390. Baffle plate 390 has a cutout 395 formed therethrough for passage of sludge-free fluid after the sludge has been substantially separated from the sludge-bearing fluid in the manner described hereinbelow. In addition, baffle plate 390 may be stainless steel for resisting corrosive attack by the sludge.

Figure 2:
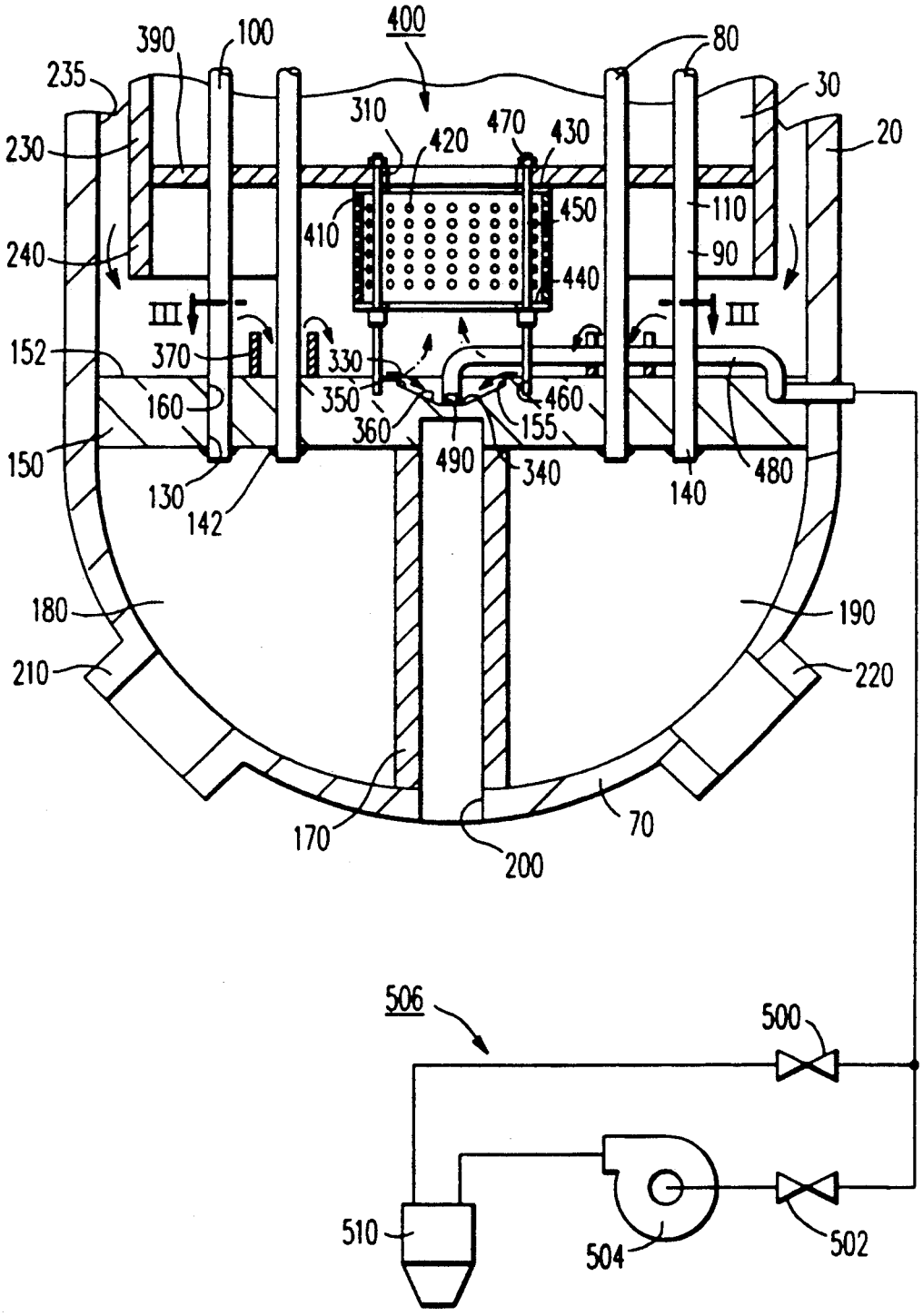
FIG. 2 is a partial cross-sectional view in elevation of a portion of the steam generator showing the invention disposed in the steam generator.

As best seen in FIGS. 1 and 2, a cylindrically-shaped flow booster, generally referred to as 400, is interposed between tube sheet 150 and baffle plate 390. Flow booster 400, which also belongs to the flow means referred to hereinabove, includes a cylindrical body 410 disposed in use substantially coaxially with tube sheet 150 and has a diameter slightly less than the diameter of the untubed central region of tube sheet 150. Cylindrical body 410 preferably has a plurality of perforations 420 formed therethrough for passage of some of the secondary fluid so that the sludge-bearing fluid does not stagnate at the outer surface of cylindrical body 410. In this regard, perforations 420 formed through flow booster 400 minimize local flow stagnation and vapor buildup as the upper layers of the radial feedwater flow impinge flow booster 400. Integral with cylindrical body 410 at the upper and lower edges thereof, respectively, are radially inwardly extending annular upper and lower support flanges 430 and 440. Flow booster 400 is supported in place by a plurality of vertical support rods 450, each having the lower end thereof anchored in an associated bore 460 formed in tube sheet 150. Support rods 450, which may be four in number, extend upwardly through complementary openings in support flanges 430 and 440 and baffle plate 390, the support rods 450 being locked in position by a plurality nuts 470 to position and support cylindrical body 410 on support rods 450. Preferably, flow booster 400 is mounted just beneath baffle plate 390, with the lower end of flow booster 400 being spaced a predetermined distance above tube sheet 150. Flow booster 400 and support rods 450 may be stainless steel for resisting corrosive attack by the sludge.

The structure of steam generator 10 as generally described hereinabove, is more fully described in U.S. Pat. No. 4,704,994 entitled "Flow Boosting And Sludge Managing System For Steam Generator Tube Sheet" issued Nov. 10, 1987 in the name of Min-Hsiung Hu and assigned to the Westinghouse Electric Corporation, the disclosure of which is hereby incorporated by reference.

Again referring to FIGS. 1, 2, 3, and 4, blowdown means, such as a generally tubular conduit or pipe 480, extends from near bottom end 340 of recess 330 to the exterior of heat exchanger 10 for efficiently transporting the sludge from recess 330 to the exterior of heat exchanger 10. Pipe 480 has an intake orifice 490 at one end thereof for passage of the sludge therethrough, the intake orifice 490 being disposed adjacent to bottom end 340. It is important that intake orifice 490 be disposed adjacent bottom end 340 so that it is in close proximity to the sludge that will settle into recess 155 for efficiently removing the sludge. Intake orifice 490 is shown in FIGS. 3 and 4 disposed concentrically within recess 330. However, it will be appreciated that intake orifice 490 may be alternatively disposed eccentrically within recess 330 so that pipe 480 will induce a swirling motion of the fluid within recess 330 to keep the sludge particles in suspension once they settle into recess 330. Keeping the sludge particles in suspension assists in preventing the clogging of intake orifice 490 with accumulated sludge. Pipe 480 is in turn connected to a valve 500, which belongs to the blowdown means referred to hereinabove, for removing the sludge from recess 340 and through pipe 480. Valve 500, when open as shown in the several figures, is capable of continuously removing the sludge through pipe 480 and into a sludge holding tank 510 to await suitable disposal during operation of steam generator 10. When steam generator 10 is shutdown, a bypass valve 502 and a bypass pump 504 that are associated with a bypass loop generally referred to as 506 are used to remove the sludge, as more fully described hereinbelow.

Figure 5:
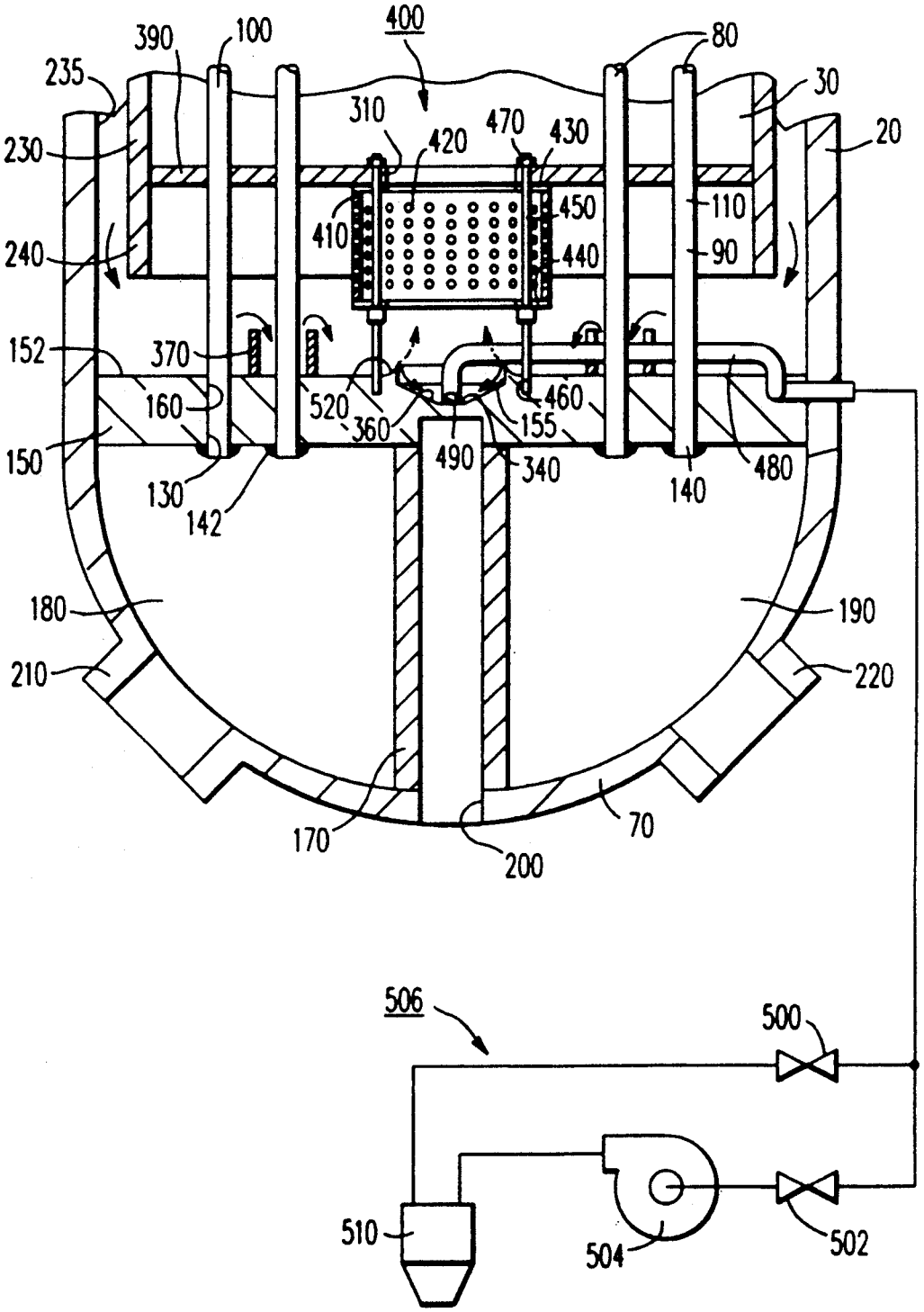
FIG. 5 is a partial cross-sectional view in elevation of the steam generator showing another embodiment of the invention.

Referring to FIG. 5, there is shown another embodiment of the invention comprising an annular peaked rim 520 surrounding open top end 330 of recess 155 and integrally attached to open top end 330 for separating the sludge from the sludge-bearing secondary fluid.

Figure 6:
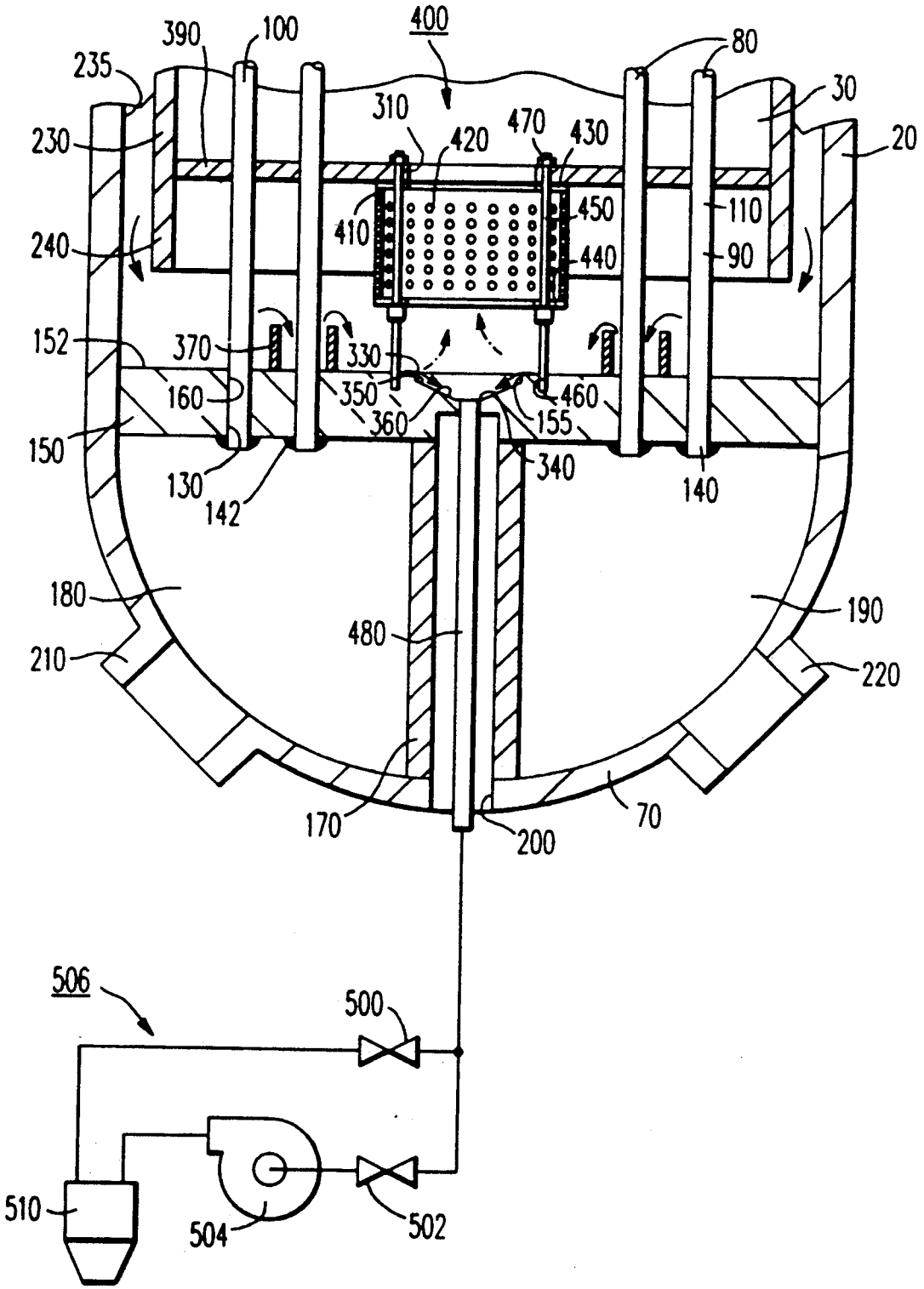
FIG. 6 is a partial cross-sectional view in elevation of the steam generator showing yet another embodiment of the invention.

Turning now to FIG. 6, there is shown yet another embodiment of the invention comprising pipe 480 extending generally vertically downwardly from bottom end 340 and through channel 200 for conducting the sludge away from heat exchanger 10. In this embodiment of the invention, the vertical orientation of pipe 480 allows gravity to assist in conducting the sludge through pipe 480. Moreover, it will be appreciated that the vertical orientation of pipe 480 in combination with the frusto-conical wall 360 of recess 155 will preferentially continuously direct the sludge through intake orifice 490 and into conduit 480 where the sludge will accumulate until removed from steam generator 10. In this case, pipe 480 will function as a vertically oriented and gravity-assisted blow-down pipe for allowing the sludge to travel through pipe 480 when the valve 500 is open.

OPERATION

During operation of steam generator 10, primary fluid from the reactor core (not shown) flows through inlet nozzle 210, into inlet plenum chamber 180, through tubes 80, into outlet plenum chamber 190 and out outlet nozzle 220. As the primary fluid flows through tubes 80, feedwater flows through feedwater inlet nozzle 260 and into the interior of feedring 270. After the feedwater enters feedring 270, it then exits feedring 270 through J-tubes 280 and falls downwardly therefrom into annular downcomer region 235. The feedwater flowing downwardly through downcomer region 235 exits the lower end of downcomer region 235 and impinges tube sheet 150. The feedwater that impinges tube sheet 150 moves laterally or radially inwardly therealong from the lower end 240 of wrapper sheet 230 (i.e., from the lower end of downcomer region 235). The feedwater then circulates upwardly around tubes 80. As the primary fluid flows through tubes 80, it gives up its heat to the feedwater circulating upwardly around tubes 80 for generating steam.

As stated hereinabove, it is most desirable to prevent the buildup of sludge on tube sheet 150 where tubes 80 intersect tube sheet 150. The flow velocity of the feedwater laterally or radially across tube sheet 150, if sufficient, can prevent the buildup of the sludge on tube sheet 150 especially where tubes 80 intersect tube sheet 150. Therefore, center lane blocks 370 are utilized in order to maximize the lateral flow velocity across tube sheet 150, where tubes 80 intersect tube sheet 150, by minimizing flow velocity in center lane 380. However, as the feedwater impinges tube sheet 150 it tends to be deflected therefrom and move vertically or upwardly along tube bundle 90, the vertical flow velocity along tube bundle 90 tending to be greater than the radial flow velocity along tube sheet 150. Therefore, baffle plate 400 is used to interfere with and thus to reduce this vertical flow velocity and to increase the flow velocity radially inwardly along tube sheet 150. Nevertheless, despite use of baffle plate 390 and center lane blocks 370, there are still regions of stagnation or low velocity within tube bundle 90 along the surface of tube sheet 150. This occurs because the flow resistance increases with distance from the inside sidewall of shell 20 and tends to reduce to a minimum before reaching the untubed central region of tube sheet 150 where recess 155 is located.

Therefore, flow booster 400 is used to enhance the flow velocity of feedwater radially inwardly along tube sheet 150. This will occur because flow booster 400 vertically constricts the radial flow between tube sheet 150 and baffle plate 390. Thus, in the region of flow booster 400, the bulk of the radial feedwater flow is forced to pass beneath flow booster 400 and close to tube sheet 150 to escape upwardly through the center of flow booster 400, through the center cutout 395 formed through baffle plate 390, and through the flow passages 312 formed through support plates 290 and 385. This causes the flow velocity to increase as it passes beneath flow booster 400 to provide relatively good sweeping action of tube sheet 150 in the regions immediately adjacent the untubed central region of tube sheet 150 where recess 155 is located. Moreover, the action of gravitational force will cause the sludge to separate from the secondary fluid and move downwardly into recess 155. In addition, perforations 420 in flow booster 400 minimize local flow stagnation and vapor buildup at the upper layers of the radial feedwater flow that impinges flow booster 400. Thus, it will be appreciated that flow booster 400 assists in reducing the low velocity areas in tube bundle 90 and serves to localize the low velocity or stagnation areas to the untubed central region of tube sheet 150 where recess 155 is located.

As the sludge-bearing fluid flows radially inwardly along tubesheet 150 from the lower end of downcomer region 235, it will tend to migrate toward recess 155 as generally shown by the solid arrows in FIGS. 2, 4, 5, and 6. As described hereinabove for one embodiment of the invention, sharp-edge shoulder 330 will enhance the separation of the sludge from the sludge-bearing secondary fluid as the sludge-bearing fluid flows in the region of recess 155. In this regard, as the secondary fluid sweeps upwardly through flow booster 400, the sludge will fall under force of gravity into recess 155 and settle therein, as illustrated by the solid arrows, thereby producing a secondary fluid that is substantially sludge-free. It will be appreciated that the sludge will separate from the sludge-bearing fluid and fall into recess 155 partly because the fluid flow velocity in the region of recess 155 is relatively low. The frusto-conical wall 360 of recess 155 assists in allowing the separated sludge to slide downwardly therealong and preferentially accumulate in the confined space defined by bottom end 340 of recess 155. Accumulation of the sludge in the confined space at bottom end 340 allows for efficient removal of the sludge from recess 155 because intake orifice 490 is disposed adjacent to bottom end 340. When valve 500 is open and bypass valve 502 is closed and bypass pump 504 is not operating, the sludge will be driven through intake orifice 490, through pipe 480 and into holding tank 510 for suitable disposal. In the several figures, valve 500 is shown as open and bypass valve 502 is shown as closed. In this regard, the sludge will blowdown through pipe 480 when valve 500 is open because the pressure inside operating steam generator 10 is greater than the pressure external to operating steam generator 10. Of course, the substantially sludge-free fluid will flow upwardly through flow booster 400 as illustrated by the dotted arrows in FIGS. 2, 4, 5, and 6.

In addition, when steam generator 10 is not operating, the pressure inside steam generator 10 is necessarily equal to the pressure external to steam generator 10. In this case, blowdown necessarily may not be used to remove the sludge. In this regard, valve 500 is closed, bypass valve 502 is opened, and bypass pump 504 is operated to remove the sludge from steam generator 10 through bypass loop 506.

Moreover, as shown in FIG. 6, pipe 480 may be alternatively located beneath bottom end 340 but in communication with recess 155. Locating pipe 480 beneath bottom end 340 but in communication with recess 155 allows gravity to assist the separated sludge in entering pipe 480 through intake orifice 490. Thus, it will be appreciated that locating pipe 480 beneath bottom end 340 allows sludge to be continuously removed from recess 155 during operation of steam generator 10 even in the temporary absence of blowdown. The frusto-conical wall 360 of recess 155 will preferentially continuously direct the sludge through intake orifice 490 and into conduit 480 where the sludge will accumulate until removed (e.g., via blowdown).

Although the present invention has been described in terms of what at present are believed to be the preferred embodiments, it will be apparent to those skilled in the art that various changes may be made to these embodiments, according to the teachings disclosed herein, without departing from the scope of the invention. For example, recess 155 may also be employed in tube bundle configurations wherein center lane 380 has some of the tubes 80 disposed thereat. The appended claims are intended to encompass all such changes.

Therefore, what is provided is a system for removing sludge from sludge-bearing fluid flowing in a vertically oriented nuclear steam generator so that the sludge is not present therein in sufficient quantities to corrosively attack components (e.g., heat transfer tubes) located in the steam generator.

What is claimed is:

1. A system for removing sludge from a sludge-bearing fluid flowing in a vertically oriented heat exchanger, comprising:
   (a) separating means disposed in the heat exchanger for separating the sludge from the sludge-bearing fluid;
   (b) blowdown means having an intake orifice disposed in said separating means for removing the sludge separated from the sludge-bearing fluid; and
   (c) flow means disposed adjacent said separating means for directing the flow of the sludge-bearing fluid toward said separating means.

2. The system according to claim 1, wherein said separating means comprises a plate member horizontally disposed in the vertically oriented heat exchanger, said plate member having a recess formed thereon for separating and collecting the sludge from the sludge-bearing fluid, the recess having an open top end and a closed bottom end.

3. The system according to claim 2, wherein the open top and of the recess is sharp-edged for assisting in separating the sludge from the sludge-bearing fluid as the sludge-bearing fluid flows in the region of the recess so that the fluid leaving the region of the recess is substantially sludge-free.

4. The system according to claim 3, wherein the recess has a depending substantially frusto-conical wall generally converging at the bottom end of the recess for providing a settling basin for the sludge as the sludge separates from the sludge-bearing fluid.

5. The system according to claim 2, wherein said blowdown means comprises:
   (a) a conduit extending from the recess to the exterior of the heat exchanger for transporting the sludge from the recess to the exterior of the heat exchanger; and
   (b) a valve connected to said conduit for removing the sludge through said conduit.

6. The system according to claim 2, wherein said flow means comprises a baffle plate disposed above said plate member and generally parallel thereto, said baffle plate having a cutout therethrough generally coaxially aligned with the recess for passage of the sludge-free fluid from the region of the recess upwardly through the cutout.

7. The system according to claim 6, wherein said flow means further comprises a flow booster cooperating with said baffle plate and interposed between said baffle plate and said plate member for directing the flow of the sludge-bearing fluid along said plate member toward the recess.

8. The system according to claim 7, wherein said flow booster is a cylindrically-shaped member having an opening therethrough generally coaxially aligned with the recess and with the cutout for passage of the sludge-free fluid from the region of the recess upwardly through the opening and the cutout.

9. The system according to claim 8, wherein said cylindrically-shaped member is connected to said baffle plate and to said plate member for maintaining the opening generally coaxially aligned with the recess and with the cutout so that the sludge-free fluid flows from the recess upwardly through the opening and the cutout.

10. The system according to claim 9, wherein said cylindrically-shaped member is stainless steel for resisting corrosion.

11. In a vertically oriented generally cylindrical nuclear steam generator shell defining a cavity having disposed therein a plurality of vertically oriented U-shaped heat transfer tubes having outside surfaces and having open ends for flow of a primary fluid therethrough, a system for removing sludge from a sludge-bearing secondary fluid flowing externally around the tubes in heat transfer relationship with the exterior surfaces of the tubes, comprising:

(a) a generally circular tube sheet having a surface thereon and having a plurality of apertures therethrough for receiving the ends of the tubes, said tube sheet disposed horizontally within the cavity and attached to the shell, said tube sheet having a recess centrally formed on the surface thereof for separating and collecting the sludge from the sludge-bearing secondary fluid, the recess having a sharp-edged generally circular open top end for assisting in separating the sludge from the sludge-bearing fluid so that the fluid leaving the region of the recess is substantially sludge-free, the recess having a closed bottom end;

(b) a pipe extending from near the closed bottom end of the recess to the exterior of the steam generator shell for transporting the sludge form the recess to the exterior of the steam generator shell;

(c) a valve connected to said pipe and disposed externally to the steam generator shell for removing the sludge through said conduit so that the sludge is removed from the steam generator shell; and (d) a generally circular baffle plate horizontally disposed in the cavity above said tube sheet and generally parallel thereto, said baffle plate having a generally circular cutout therethrough generally coaxially aligned with the recess for passage of the sludge-free fluid from the region of the recess upwardly through the cutout.

12. The system according to claim 11, further comprising a flow booster cooperating with said baffle plate and interposed between said baffle plate and said tube sheet for directing the flow of the sludge-bearing fluid along said tube sheet toward the recess.

13. The system according to claim 12, wherein said flow booster is a generally cylindrically-shaped body having a vertically oriented opening therethrough generally coaxially aligned with the recess and with the cutout for passage of the sludge-free fluid from the region of the recess upwardly through the opening and the cutout, said cylindrically-shaped body connected to said baffle plate and to said tube sheet for maintaining the opening generally coaxially aligned with the recess and with the cutout so that the sludge-free fluid flows from the recess upwardly through the opening and the cutout.

14. The system according to claim 12, wherein said flow booster is stainless steel for resisting corrosion.

15. The system according to claim 11, wherein the open top end is a sharp-edged depending annular shoulder for assisting in separating the sludge from the sludge-bearing fluid.

16. The system according to claim 11, wherein the recess has a depending substantially frusto-conical wall generally converging at the bottom end of the recess for providing a settling basin for the sludge as the sludge settles into the recess, the wall extending from near the open top end to the bottom end of the recess.

17. The system according to claim 11, further comprising a bypass loop connected to said pipe for removing the sludge from the steam generator when the steam generator is shutdown.

18. The system according to claim 11, wherein the open top end is an annular peaked rim for separating the sludge from the sludge-bearing fluid.

19. The system according to claim 11, wherein said pipe is stainless steel for resisting corrosion.

20. The system according to claim 11, wherein said baffle plate is stainless steel for resisting corrosion.

* * * * *